United States Patent [19]

Kauffman

[11] 4,038,908

[45] Aug. 2, 1977

[54] FLOATING SEALING PRESSURE MEANS FOR CARTON ENDS

[75] Inventor: Ivan L. Kauffman, Commerce Township, Oakland County, Mich.

[73] Assignee: Ex-Cell-O Corporation, Troy, Mich.

[21] Appl. No.: 731,383

[22] Filed: Oct. 12, 1976

[51] Int. Cl.[2] ..... B31B 1/64

[52] U.S. Cl. ..... 93/36.3; 93/44.1 R

[58] Field of Search ..... 53/192, 374, 375, 387; 93/12 R, 12 C, 36.3, 44, 44.1 R, 39.2, 36.8; 100/281

[56] References Cited

U.S. PATENT DOCUMENTS

| | | | |
|---|---|---|---|
| 1,535,463 | 4/1925 | Gault | 93/36.3 |
| 1,563,323 | 12/1925 | Bergstein | 93/44.1 R |
| 2,412,924 | 12/1946 | Stover | 100/281 X |
| 3,971,300 | 7/1976 | Bachner | 93/36.8 |

*Primary Examiner*—James F. Coan

[57] ABSTRACT

A floating sealing pressure means for sealing carton ends, and which eliminates undesirable loading of a carton mandrel support system in a packaging machine due to carton and sealing pressure. The floating sealing pressure means is disclosed in a carton bottom sealing embodiment which employs a pressure pad for sealing engagement with the bottom end of a carton, and a reaction or counter pressure pad. The pressure pad and reaction pad are movably supported so as to function like a "C" clamp, so as to allow the pressure pad and reaction pad to operate in alignment with each other and locate on a carton mandrel so as to impart substantially no load into the supporting structure of the mandrel during a carton bottom sealing operation. The pressure pad and reaction pad are powered by a toggle actuator means which balances the loading on the supporting system of the mandrel.

7 Claims, 2 Drawing Figures

FLOATING SEALING PRESSURE MEANS FOR CARTON ENDS

BACKGROUND OF THE INVENTION

1. Field of the Invention

This invention relates to coated paperboard carton forming machines, and generally, to carton end closing means for these machines. The invention is particularly concerned with a carton bottom end sealing means which comprises a floating counter pressure device to produce an equal opposing reaction force that substantially cancels the high sealing pressure generated during a bottom sealing operation.

2. Description of the Prior Art

The prior art packaging machines for coated paperboard cartons employ carton bottom end closing apparatuses which impart an undesirable high load on the carton mandrel support system during a carton bottom sealing operation due to the carton bottom high sealing pressures. The loading caused by the carton bottom high sealing pressures is exerted at an off center point on the mandrel turret, so as to impart a deflection load on the mandrel turret, and the mandrel turret spindle. The last mentioned deflection load is taken up by the mandrel turret spindle bearings which is detrimental to said spindle bearings. The carton bottom end high sealing pressure in said prior art packaging machines is thus reflected back into various parts of the machine, so as to injuriously stress many machines parts. For example, the sealing pressure causes a springing load on the mandrel turret and it also results in a bending load on the turret shaft.

SUMMARY OF THE INVENTION

In accordance with the present invention, the floating sealing pressure means for sealing carton ends, and especially carton bottom ends, includes a pressure pad for sealing engagement with the bottom end of a carton, and a reaction or counter-pressure pad which is aligned with the pressure pad for counterbalancing the high sealing pressure. The reaction pad is carried on an upper support arm which maintains the reaction pad in alignment with the longitudinal axis of a carton mandrel on a rotating mandrel turret of a carton packaging machine and in a position above the mandrel. The upper support arm is fixedly mounted on the top end of a vertical carrier shaft which is supported for vertical movement by a C-shaped support structure. The lower end of the vertical carrier shaft is supported by a spring means at the lower end thereof to allow downward movement of the shaft and the reaction pad from a normal raised position during a sealing operation.

A pressure pad is carried on a lower support arm which maintains the pressure pad in alignment with the longitudinal axis of said carton mandrel and in a position below the mandrel. The lower support arm is fixedly mounted on a carrier housing which is slidably mounted on the reaction pad carrier shaft. Spring means is provided on the reaction pad carrier shaft for centering the reaction pad and pressure pad relative to the mandrel. A toggle actuator means is operatively connected between the lower support arm which carries the pressure pad and the lower end of the reaction pad carrier shaft, whereby when the toggle actuator means is operated in one direction, the pressure and reaction pads are moved to inoperative positions, and when the toggle actuator means is operated in the other direction, the reaction pad engages the rotating mandrel turret on the top end thereof so as to counterbalance the high sealing pressure imparted on the lower end of the mandrel by the pressure pad.

Other features and advantages of this invention will be apparent from the following detailed description, appended claims, and the accompanying drawing.

DESCRIPTION OF THE PREFERRED EMBODIMENT

Figures 1, 2:
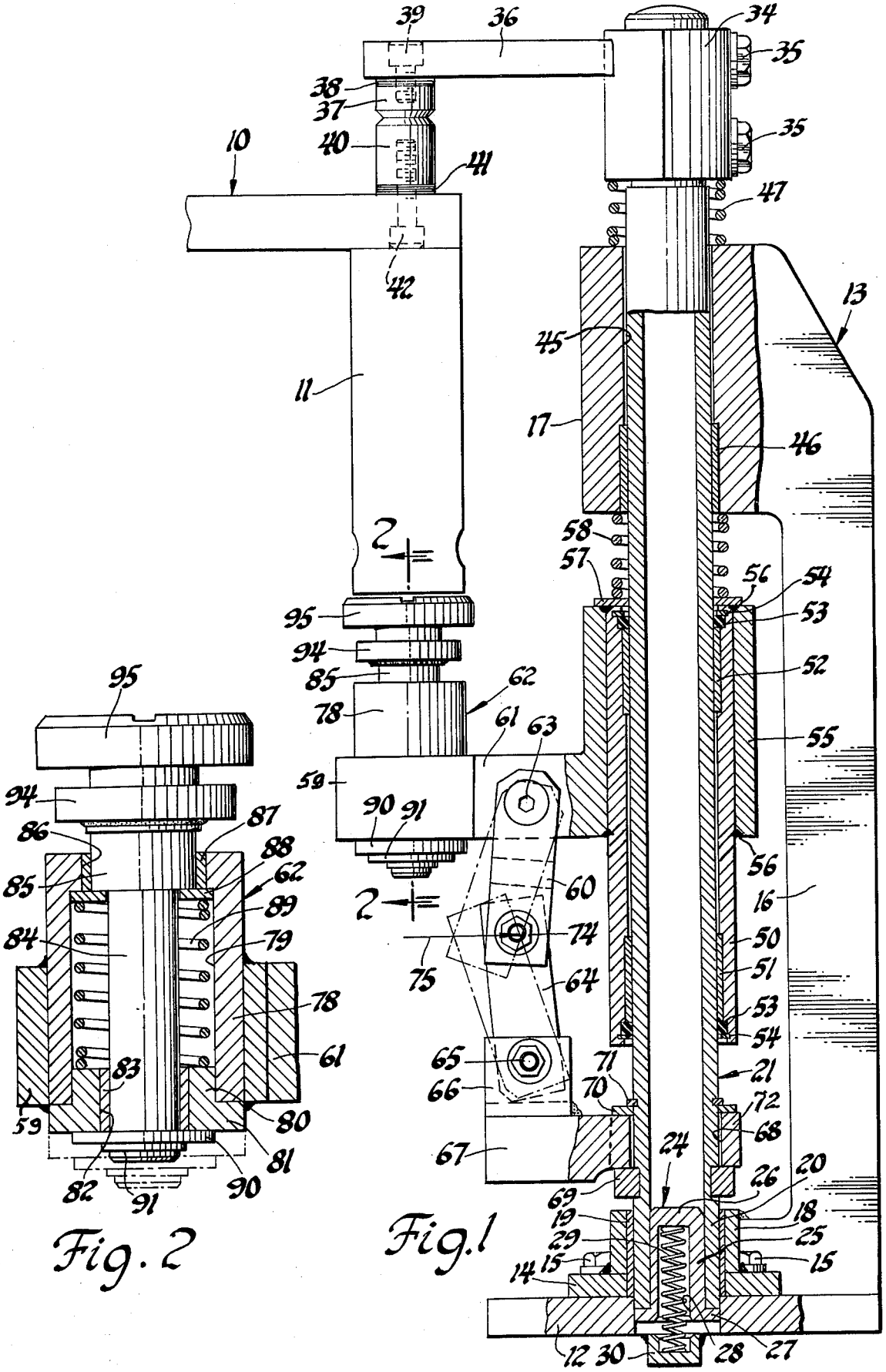
FIG. 1 is an elevation section view of a floating sealing pressure means for carton end sealing apparatuses employed in packaging machines.
FIG. 2 is an elevation section view of the sealing pressure pad illustrated in the structure of FIG. 1, taken along the line 2—2 thereof, and looking in the direction of the arrows.

Referring now to the drawing, and in particular to FIG. 1, the numeral 10 schematically represents a rotating turret in a carton packaging machine which carries carton forming mandrels, of the type generally indicated by the numeral 11, on which are mounted expanded carton blanks for forming into a container with a closed bottom. The numeral 13 generally designates a C-shaped support means which is carried on a base plate 12. The C-shaped support means 13 includes a vertical elongated support post 16 which has an integral cylindrical support sleeve 17 on the upper end thereof. The lower end of the vertical support post 16 is fixedly secured, as by welding, on an annular circular mounting plate 14. The mounting plate 14 is secured by any suitable means, as by machine screws 15, to the base plate 12.

A reaction pad carrier shaft, generally indicated by the numeral 21, is vertically disposed and has its lower end 20 slidably mounted in a sleeve bearing 19 which is operatively mounted in the guide sleeve 18. The reaction pad carrier shaft 21 is normally biased upwardly to an inoperative position by a reaction pad shaft spring means generally indicated by the numeral 24. The spring means 24 includes a cylindrical retainer structure which houses a compression spring 29. The retainer structure includes a cylindrical side wall 25 which is enclosed on the upper end thereof by an integral top end wall 26. A radially extended integral flange 27 is formed on the lower end of the cylindrical side wall 25. A spring retainer is provided with a bore 28 which extends inwardly thereof from the lower end and in which is operatively seated the compression spring 29. The lower end of the spring 29 is enclosed in a suitable spring retainer cap which is welded to the lower side of the space plate 12. As shown in FIG. 1, the reaction pad carrier shaft 21 is in a lowered operative position as described more fully hereinafter.

As shown in FIG. 1, the reaction pad carrier shaft 21 has fixedly mounted on the upper end thereof by any suitable means, as by machine screws 35, a mounting sleeve 34. A horizontal support arm 36 has the inner end thereof fixedly secured to the mounting sleeve 34 by any suitable means, as by being welded thereto. A movable reaction pad button 37 is fixedly secured on the lower side of the support arm 36 at the outer end thereof by suitable shims 38 and a machine screw 39. The turret 10 is provided with a fixed reaction pad button 40 that is engaged by the movable reaction pad button 37 during a sealing operation. The fixed reaction pad button 40 is secured to the turret 10 by any suitable means, as by the shims 41 and machine screws 42, in a position above the mandrel 11 and in longitudinal vertical alignment therewith.

As shown in FIG. 1, the upper end of the reaction pad carrier shaft is slidably mounted through a vertical bore 45 in the vertical support sleeve 17. A suitable guide bushing 46 is operatively mounted in the bore 45. A centering spring 47 is mounted between the upper end of the integral support sleeve 17 and the lower end of the mounting sleeve 34 on the upper end of the carrier shaft 21. A sliding structure is operatively mounted about the lower end of the carrier shaft 21 and it includes a cylindrical housing 50 which has a lower guide bushing 51 and an upper guide bushing 52 that slidably mounts the cylindrical housing 50 on the carrier shaft 21.

An oil seal 53 is disposed at the lower end of the guide bushing 51 and at the upper end of the guide bushing 52. The oil seals 53 are retained in position by suitable retaining rings 54. A cylindrical housing 55 is mounted around the upper end of the slide housing 50, and it is secured thereto by any suitable means as by welding, as indicated by the numeral 56. A thurst washer 57 is carried on the upper end of the housing structure formed by the housing members 50 and 55, and it has seated thereon the lower end of a centering spring 58. The upper end of the centering spring 58 is seated against the lower end of the fixed support sleeve 17.

A lower support arm 61 is integrally attached to the slide housing member 55, and it is adapted to carry a pressure pad means generally indicated by the numeral 62. An integral carrier sleeve 59 is formed on the outer end of the lower support arm 61. An upper toggle link 60 has its upper end pivotally secured to the lower support arm 61 by suitable pivot shaft means 63. A lower toggle link 64 has its lower end pivotally attached to a toggle attachment plate 66 by any suitable means, as by a suitable pivot shaft means 65. The toggle attachment plate 66 is fixed, as by welding, to the upper side of a lifter bar 67 which has an integral sleeve 72 formed thereon. The lifter bar sleeve 72 has a bore 68 and is mounted around the lower end of the reaction pad carrier shaft 21, and it is fixed against longitudinal movement thereon by a collar 69 on the lower side thereof and a washer 70 on the upper side thereof which is fixed in place by a retaining ring 71. The collar 69 is seated in a suitable annular groove formed in the outer periphery of the carrier shaft 21.

The free end of the toggle links 60 and 64 are pivotally connected by any suitable means, as by the pivot shaft means 74. The numeral 75 indicates the direction of force for moving the toggle links 60 and 64 to the solid line operative position shown in FIG. 1 for bringing the pressure pad means 62 upwardly into operative engagement with the lower end of the mandrel and the reaction pad 37 downwardly into operative engagement with the fixed pad 40 on the turret 10. The broken line positions of the toggle links 60 and 64 show the positions to which the toggle links are moved to move the reaction and pressure pads to an inoperative position. As shown in FIG. 1, the reaction pad 37 and the pressure pad means 62 are in the operative position. When the toggle actuator means is moved to the broken line position shown in FIG. 1, the carrier shaft 21 would be moved upwardly to remove the reaction pad 37 from the pad 40, and the pressure pad means 62 would be moved downwardly from the position shown in FIG. 1.

As shown in FIG. 2, the pressure pad means 62 includes a cylindrical housing 79 which is fixed by any suitable means, as by welding, to the carrier sleeve 59. The housing 78 has formed therein a cylindrical spring chamber 79 which has mounted in the lower end thereof a sleeve 80 that has a flange 81 that overlaps the bottom end of the housing 78 and is fixed thereto by any suitable means, as by welding. The sleeve 80 has a vertical bore 82 formed therethrough in which is seated a suitable sleeve bearing 83. A vertically disposed shaft 84 is mounted in the spring chamber 79 and has its lower end slidably mounted in the sleeve bearing 83.

Integrally formed on the upper end of the shaft 84 is an enlarged diameter shaft portion 85 which is slidably mounted in a sleeve bearing 87 that is positioned in a bore 86 formed in an upper end wall of the spring chamber 79 in the housing 78. A spring 89 is mounted in the spring chamber 79 and has its upper end seated against a thrust washer 88 disposed in the upper end of the spring chamber 79. The lower end of the spring 89 is seated on the inner end of the sleeve 80. It will be seen that the spring 89 biases the shafts 84 and 85 into the position shown in FIG. 2, but that these shafts may be moved downwardly against the pressure of the spring 89 during a bottom sealing operation. The shaft 84 is secured in the position shown in FIG. 2 by a washer 90 mounted around the lower end of the shaft 84 which extends outwardly of the sleeve 80 and a suitable retaining ring 91.

Operatively mounted on the shaft 85 is a conventional pressure pad 95 which is attached by conventional equalizing mechanism (not shown) that allows the pressure pad 95 to float to square up to the bottom of the mandrel to apply pressure on the entire bottom of the mandrel. The sealing pad equalizing mechanism is not part of the present invention, and accordingly, has not been shown.

In use, the toggle actuator means is operated so as to move the toggle links 60 and 64 from the broken line positions shown in FIG. 1, where they are in inoperative positions with the pressure pad 95 in a lowered position and the reaction pad 37 in a raised position. The operating of the toggle links by a force 75 in a direction to the right, as viewed in FIG. 1, moves the lower support arm 61 upwardly on the shaft 21 so as to move the pressure pad 95 into operative engagement with the bottom of the mandrel 11. Simultaneously, the toggle 64 exerts a downward pressure on the carrier shaft 21, against the normal upward bias of spring 29, so as to move the reaction pad 37 into operative engagement with the fixed pad 40 on the turret 10. After a bottom sealing operation, the force 75 is reversed and the toggle arms 60 and 64 are moved to the left to the broken line positions, so as to lower the pressure pad 95 and raise the reaction pad 37.

The last mentioned movement of the toggle links 60 and 64 permits the spring 29 to move the carrier shaft upwardly to an inoperative position. It will be seen that the spring 29 supports the weight of the floating sealing mechanism, and that there is substantially no reaction into the turrent 10 during a bottom sealing operation. The floating sealing pressure means of the present invention provides an accurate control over the clamping pressure, and the clamping pressure is not reflected back into the packaging machine. Since the pressure is completely independent of the rest of the machine, there is no limitation to the range of the compression pressure that may be employed in a bottom sealing operation. A further advantage of the floating sealing pressure means of the present invention is that it is free from any expansion effect in the rest of the packaging machine, as for example, expansion due to heat and so forth.

While it will be apparent that the preferred embodiment of the invention herein disclosed is well calculated to fulfill the objects above stated, it will be appreciated that the invention is susceptible to modification, variation and change.

What is claimed is:

1. In a carton packaging machine, including a support structure carrying a carton forming mandrel carried by the machine, the combination comprising:

a. a support means;

b. a carrier shaft movably mounted on said support means;

c. an upper support arm carried by support shaft;

d. a reaction pad mounted on said upper support arm and movably mounted over a carton forming mandrel and in alignment with the longitudinal axis thereof;

e. means for normally biasing said carrier shaft upwardly to an inoperative position with the reaction pad raised above the mandrel;

f. housing slidably mounted on said carrier shaft;

g. a lower support arm carried by said last mentioned housing;

h. pressure pad means mounted on said lower support arm and movable from a lowered inoperative position to a raised operative position against the bottom of the mandrel when said housing carrying said lower support arm is moved upwardly; and i. toggle actuator means operatively connected to said lower support arm and to said carrier shaft for moving said lower support arm upwardly and said carrier shaft downwardly, to move the reaction pad into operative engagement with the mandrel carrier structure and to move the compression pad means into operative engagement with the lower end of the mandrel.

2. A carbon packaging machine as defined in claim 1, wherein:

a. said means for normally biasing said carrier shaft upwardly comprises a spring means.

3. A carton packaging machine as defined in claim 2, wherein:

a. said support means is provided with an upper guide sleeve and a lower guide sleeve for guiding the upward and downward movement of said carrier shaft.

4. A carton packaging machine as defined in claim 3, including:

a. a first centering spring means mounted on said carrier shaft between said upper support arm and said upper guide sleeve; and, b. a second centering spring mounted between the lower end of said upper guide sleeve and the upper end of the housing carrying said lower support arm.

5. A carton packaging machine as defined in claim 4, wherein:

a. said pressure pad means includes a pressure pad movably mounted on said lower support arm.

6. A carton packaging machine as defined in claim 5, including:

a. means for normally biasing said pressure pad to an upward position and to allow a downward movement of the pressure pad.

7. A carton packaging machine as defined in claim 6, wherein:

a. said biasing means is a spring means.

* * * * *